US005973280A

United States Patent [19]

Gula et al.

[11] Patent Number: 5,973,280

[45] Date of Patent: Oct. 26, 1999

[54] CIRCUIT BREAKER WITH AN ANTI-LIFT PIVOT HANDLE

[75] Inventors: Lance Gula, Clinton; Yu Wei Chou, Moontownship; Henry Kenneth Pruszynski, Pittsburgh; James Alan Trax, Coraopolis; Trent Allan Chontas, East Pittsburgh, all of Pa.

[73] Assignee: Eaton Corporation, Cleveland, Ohio

[21] Appl. No.: 09/046,389

[22] Filed: Mar. 23, 1998

[51] Int. Cl.[6] ..... H01H 3/00

[52] U.S. Cl. ..... 200/339; 200/400

[58] Field of Search ..... 200/339, 400; 335/167–174, 16

[56] References Cited

U.S. PATENT DOCUMENTS

| | | | |
|---|---|---|---|
| 3,525,959 | 8/1970 | Ellsworth et al. | 335/166 |
| 3,614,865 | 10/1971 | Widmer et al. | 58/90 |
| 3,815,059 | 6/1974 | Spoelman | 335/16 |
| 3,863,042 | 1/1975 | Nicol | 200/153 |
| 4,077,025 | 2/1978 | Slade et al. | 335/16 |
| 4,166,205 | 8/1979 | Maier et al. | 200/153 |
| 4,540,961 | 9/1985 | Maier | 335/16 |
| 4,642,431 | 2/1987 | Tedesco et al. | 200/153 |

*Primary Examiner*—M. L. Gellner
*Assistant Examiner*—Nhung Nguyen
*Attorney, Agent, or Firm*—Martin J. Moran

[57] ABSTRACT

A circuit breaker handle is provided with a curved bearing surface at its pivot point. The handle bearing surface has a substantially constant radius and is connected to the body of the handle with a necked down handle extension. The handle extension has a width that is less than the width of the curved bearing surface at the point of connection between the bearing surface and the necked down region. The handle pivot mates with a corresponding bearing surface on a notch in the side plate that it pivots within. The arc of the curved bearing surface in the side plate is greater than that of the corresponding bearing surface on the handle and captures the handle pivot within the notch in the sideplate, so the handle cannot lift off the bearing surface on the notch as it is moved.

2 Claims, 4 Drawing Sheets

CIRCUIT BREAKER WITH AN ANTI-LIFT PIVOT HANDLE

BACKGROUND OF THE INVENTION

1. Field of the Invention

The device of the present invention generally relates to molded case circuit breakers and, more particularly, to operating mechanisms for controlling the mechanical operation of molded case circuit breakers.

2. Background Information

Circuit breakers and, more particularly, molded case circuit breakers are old and well known in the prior art. Examples of such devices can be found in U.S. Pat. Nos. 3,525,959; 3,614,865; 3,815,059; 3,863,042; 4,077,025; and 4,166,205. In generally, prior art molded case circuit breakers have been provided with moveable contact arrangements and operating mechanisms designed to provide protection for an electrical circuit or system against electrical faults, specifically, electrical overload conditions, low level short circuit or fault current conditions, and, in some cases, high level short circuit or fault current conditions. Prior art devices have utilized a trip mechanism for controlling the movement of an over-center toggle mechanism to separate a pair of electrical contacts upon an overload condition or upon a short circuit or fault current condition. Such trip mechanisms have included a bimetal moveable in response to an overload condition to rotate a trip bar, resulting in the movement of the over-center toggle mechanism to open a pair of electrical circuit breaker contacts. Such prior art devices have also utilized an armature moveable in response to the flow of short circuit or fault current to similarly rotate the trip bar to cause the pair of contacts to separate. At least some prior art devices use blow apart contacts to rapidly interrupt the flow of high level short circuit or fault currents.

While many prior art devices have provided adequate protection against fault conditions in an electrical circuit, a need existed for dimensionally small molded case circuit breakers capable of fast, effective and reliable operation. Many operating mechanisms now used to control the mechanical operation of such circuit breakers require relatively large amounts of operating space. Therefore a need existed for an operating mechanism for molded case circuit breakers that utilizes a relatively small amount of space yet provides fast, effective and reliable operation for protecting an electrical system against overload or fault current conditions. Such a system is described in U.S. Pat. No. 4,540,961, issued Sep. 10, 1985 and assigned to the assignee of this application. While the improvement provided by the foregoing patent met the objective, operating experience has indicated that there is still room for improvement under certain abnormal operating conditions. For example, it has been found that when the contacts are welded, though the handle arm rotation is stopped by hitting a bump on the crossbar, the handle arm lifts up off of its pivot surface allowing the handle arm to move further towards the off position without affecting the desired change of state of the toggle or adding pressure to open the contacts.

SUMMARY OF THE INVENTION

An object of the present invention is to provide a new and improved circuit breaker.

Another object of the present invention is to provide a new and improved molded case circuit breaker having a highly integrated operating mechanism that occupies a relatively small amount of space while providing fast, efficient and reliable protection in an electrical circuit from overload and fault current conditions.

Another object of the present invention is to provide a new and improved operating mechanism for a circuit breaker that translates the maximum amount of force placed on the handle to a force directed to drive the contacts open when they are welded as a result of the conduction of excess current.

These and other objects are achieved by the present invention which relates to a molded case circuit breaker having a highly integrated operating mechanism that employs an over the center toggle using a manual activation handle that is spring biased against a notch in a side plate within which the handle arm pivots. The pivot point on the handle is captured in the notch over its full arc of rotation so that the handle cannot lift off of its bearing surface even if it meets interference to its further movement. Thus, the force on the handle is directly translated to the force pressuring the contacts to separate.

BRIEF DESCRIPTION OF THE DRAWINGS

The above and other objects and advantages and the novel features of the present invention will become apparent from the following detailed description of the preferred and alternative embodiments of a molded case circuit breaker illustrated in the accompanying drawings wherein.

DESCRIPTION OF THE PREFERRED EMBODIMENTS

Figure 1:
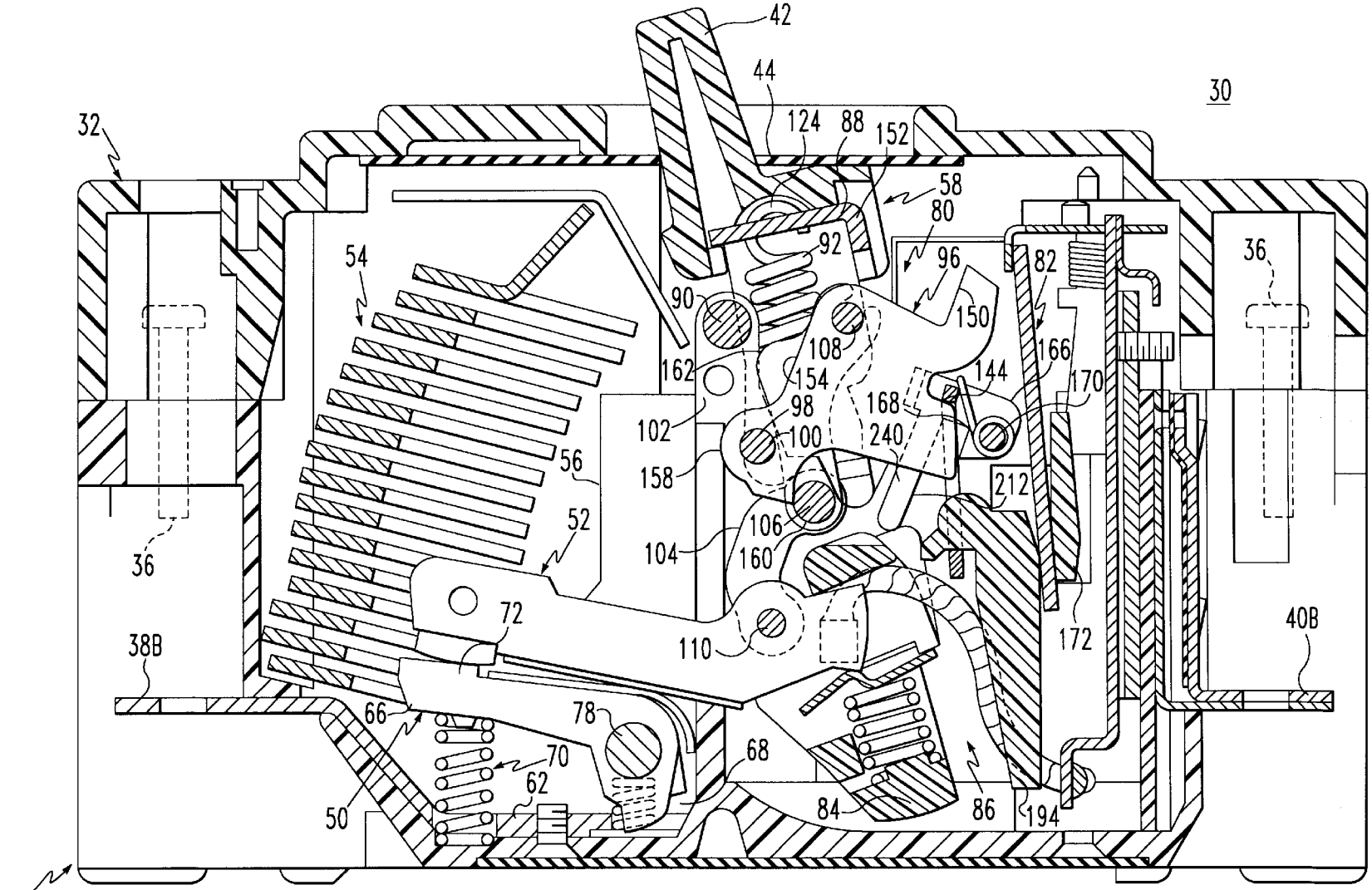
FIG. 1 is an enlarged cross section overview of a molded case circuit breaker depicting the device in its CLOSED and BLOWN-OPEN positions.
Figure 2:
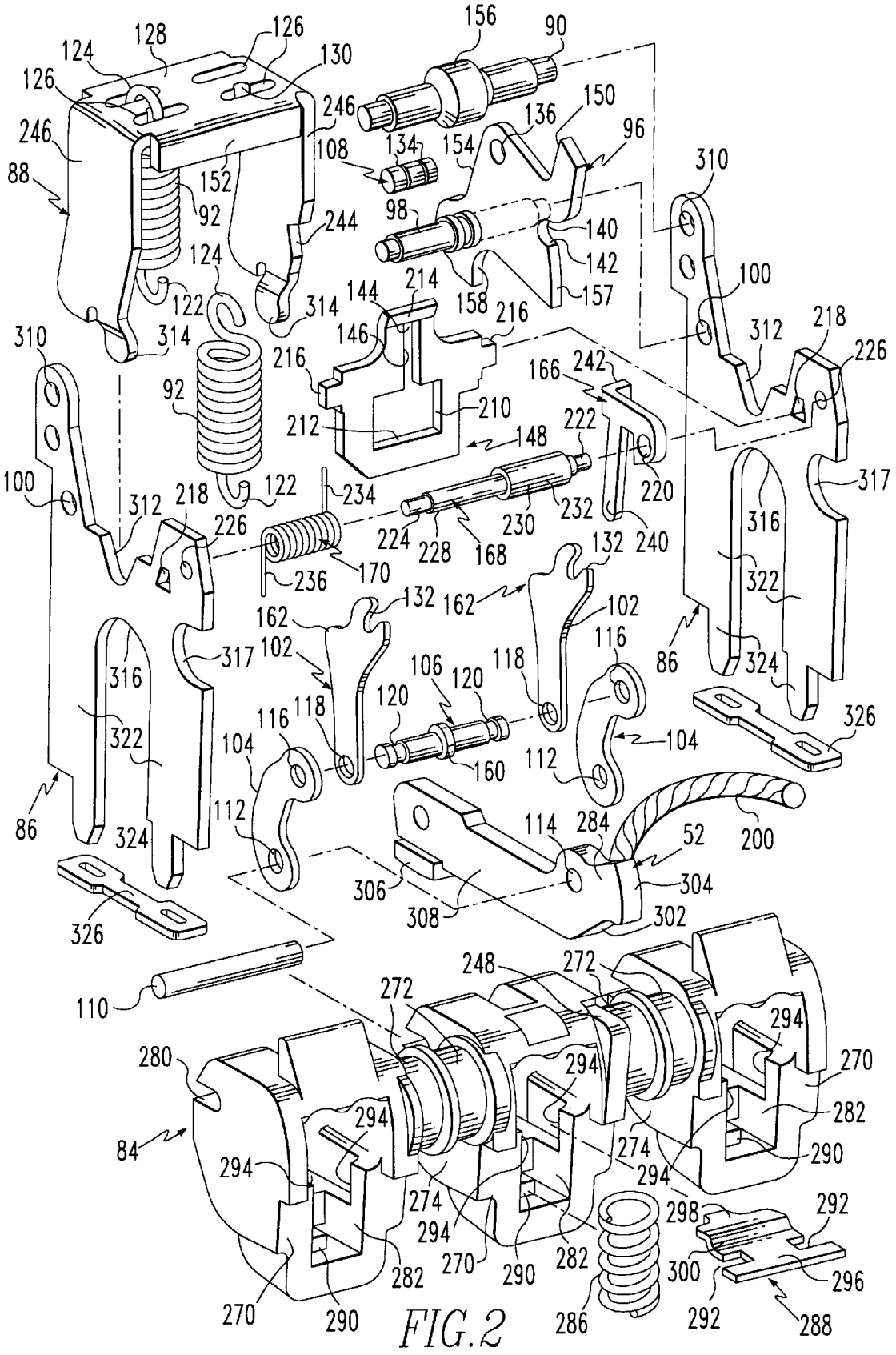
FIG. 2 PRIOR ART
FIG. 2 is an enlarged, exploded prospective view of portions of the operating mechanisms of the prior art circuit breaker of the type illustrated in FIG. 1, to which this invention is applicable.
Figure 3:
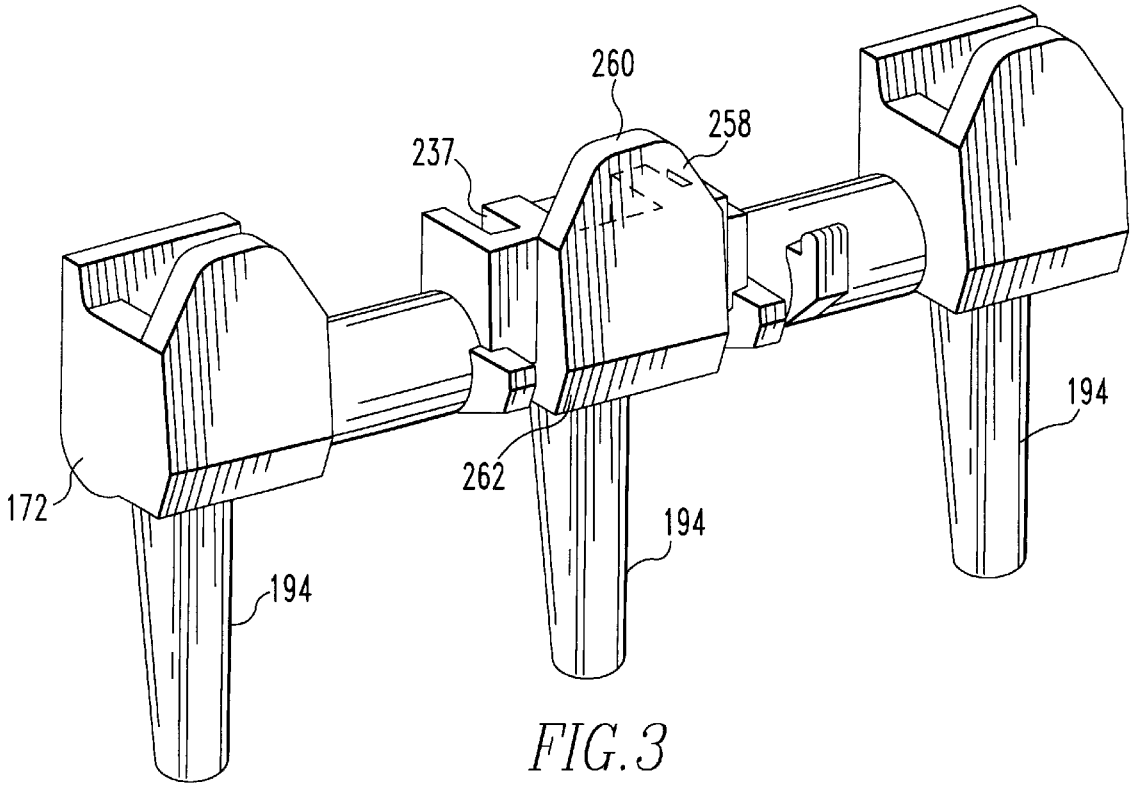
FIG. 3 is an enlarged, fragmentary, cross sectional view of an alternative embodiment of the device of FIG. 1 depicting the device in its CLOSED and BLOWN-OPEN positions.

Referring to FIGS. 1 through 3, there is illustrated a common molded case circuit breaker 30 constructed in accordance with an operating mechanism design to which the present invention is applicable. An overall simplified description of the circuit breaker will follow to enhance an understanding of the environment in which the invention will operate and the problems that it overcomes. A more detailed understanding of the individual components of the circuit breaker and how they interact can be found in U.S. Pat. No. 4,540,961, issued Sep. 10, 1985 and assigned to the assignee of this application. The following description will use the same reference characters employed in the description of the foregoing patent to assist in that understanding.

The circuit breaker 30 includes a molded, electrically insulating, top cover 32 mechanically secured to a molded, electrically insulating, bottom cover or base 34 by a plurality of fasteners 36. A plurality of line terminals 38A, 38B and 38C are provided, one for each pole or phase as are a plurality of load terminals 40A, 40B, and 40C. For the purpose illustration, only terminals 38B and 40B are shown in FIG. 1. These terminals are used to serially, electrically connect the circuit breaker 30 into a three phase electrical circuit for protecting a three phase electrical system, though, it will readily be appreciated by those skilled in the art that a corresponding mechanism of the same design can be provided for any number of phases that are employed.

The circuit breaker 30 further includes an electrically insulating, rigid, manually engageable handle 42 extending through an opening 44 in the top cover 32 for setting the circuit breaker 30 to its CLOSED position or its OPEN position. The circuit breaker 30 also may assume a BLOWN-OPEN position, or a TRIPPED position. Subsequently to being placed in its TRIPPED position, the circuit breaker 30 may be reset for further protective operation by moving the handle 42 from its TRIPPED position passed its OPEN position. The handle 42 may then be left in its OPEN position or moved to its CLOSED position, in which case the circuit breaker 30 is ready for further protective operation.

As its major internal components, the circuit breaker 30 includes a lower electrical contact 50, an upper electrical contact 52, an electrical arc shoot 54, a slot motor 56, and an operating mechanism 58. The arc shoot 54 and slot motor are conventional and not particularly relevant to the invention. Therefore, they will not be discussed in greater detail.

The lower electrical contact 50 includes a lower, formed, stationary member 62 secured to the base 34, a lower moveable contact arm 66, a pair of electrical contact compression springs 68, a lower contact biasing means or compression spring 70, a contact 72 for physically and electrically contacting the upper electrical contact 52. Effective conductive contact and current transfer is achieved between the lower formed stationary member 62 and the lower moveable contact 66 through the rotatable pin 78 so that effective current transfer is achieved between the line terminal 38B and the lower contact 50 as is more fully described in U.S. Pat. No. 4,540,961.

The operating mechanism 58 includes an over-center toggle mechanism 80; a trip mechanism 82; an integral or one-piece molded crossbar 84; a pair of rigid, opposed or spaced apart, metal side plates 86; a rigid, pivotable, metal handle yoke 88; a rigid stop pin 90; and a pair of operating tension springs 92 (all of which can be seen in the exploded view shown in FIG. 2).

The over-center toggle mechanism 80 includes a rigid, metal cradle 96 that is rotatable about the longitudinal central access of a cradle support pin 98. The opposite longitudinal ends of the cradle support pin 98 in an assembled condition are retained in a pair of apertures 100 formed through the side plates 86.

The toggle mechanism 80 further includes a pair of upper toggle links 102, a pair of lower toggle links 104, a toggle spring pin 106, and an upper toggle link follower pin 108. The lower toggle links 104 are secured to the upper electrical contact 52 by a toggle contact pin 110. Each of the lower toggle links 104 includes a lower aperture 112 for receipt therethrough of the toggle pin 110. The toggle contact pin 110 also passes through an aperture 114 formed through the upper electrical contact 52 enabling the upper electrical contact 52 to freely rotate about the central longitudinal axis of the pin 110. The opposite longitudinal ends of the pin 110 are received and retained in the crossbar 84. Thus, movement of the upper electrical contact 52 under other than high level short circuit or fault current conditions and the corresponding movement of the crossbar 84 is effected by movement of the lower toggle links 104. In this manner, movement of the upper electrical contact 52 by the operating mechanism 58 in the center pole or phase of the circuit breaker 30 simultaneously, through the rigid cross-bar 84, causes the same movement in the upper electrical contacts 52 associated with the other poles or phases of the circuit breaker 30.

Each of the lower toggle links 104 also includes an upper aperture 116; and each of the upper toggle links 102 includes an aperture 118. The pin 106 is received through the apertures 116 and 118, thereby interconnecting the upper and lower toggle links 102 and 104 and allowing rotational movement therebetween. The opposite longitudinal ends of the pin 106 include journals 120 for the receipt and retention of the lower hooked or curved ends 122 of the springs 92. The upper, hooked or curved ends 124 of the springs 92 are received through and retained in slots 126 formed through an upper, planar or flat surface 128 of the handle yoke 88. At least one of the slots 126 associated with each spring 92 includes a locating recess 130 for positioning the curved ends 124 of the spring 92 to minimize or prevent substantial lateral movement of the springs 92 along the lengths of the slots 126.

In an assembled condition, the disposition of the curved ends 124 within the slots 126 and the disposition of the curved ends 122 in the journals 120 retain the links 102 and 104 in engagement with the pin 106 and also maintain the springs 92 under tension, enabling the operation of the over-center toggle mechanism 80 to be controlled by and responsive to external movements of the handle 42.

The upper links 102 also include recesses or grooves 132 for receipt in and retention by a pair of spaced apart journals 134 formed along the length of the pin 108. The center portion of the pin 108 is configured to be received in an aperture 136 formed the cradle 96 at a location spaced by a predetermined distance from the access of rotation of the cradle 96. Spring tension from the springs 92 retains the pin 108 in engagement with the upper toggle links 102. Thus, rotational movement of the cradle 96 effects a corresponding movement or displacement of the upper portion of the links 102.

The cradle 96 includes a slot or groove 140 having an inclined flat latch surface 142 formed therein. A surface 142 is configured to engage an inclined flat cradle latch surface 144 formed at the upper end of an elongated slot or aperture 146 formed through a generally flat, intermediate latch plate 148. The cradle 96 also includes a generally flat handle yoke contacting surface 150 configured to contact a downwardly depending elongated surface 152 formed along one edge of the upper surface 128 of the handle yoke 88. The operating springs 92 move the handle 42 during a trip operation; and the surfaces 150 and 152 locate the handle 42 in a TRIPPED position, intermediate the CLOSED position, and the OPEN position of the handle 42, to indicate that the circuit breaker 30 has tripped. In addition, the engagement of the surfaces 150 and 152 resets the operating mechanism 58 subsequent to a trip operation by moving the cradle 96 in a clockwise direction against the bias of the operating springs 92 from its TRIPPED position to and past its OPEN position to enable the relatching of the surfaces 142 and 144.

The cradle 96 further includes a generally flat elongated top surface 154 for contacting a peripherally disposed, radially outwardly protruding portion or rigid stop 156 formed about the center of the stop pin 90. The engagement of the surface 154 with the rigid stop 156 limits the movement of the cradle 96 in a counterclockwise subsequent to a trip operation. The cradle 96 also includes a curved, intermediate latch plate follower surface 157 for maintaining contact with the outermost edge of the incline latch surface 144 of the intermediate latch plate 148 upon the disengagement of the latch surfaces 142 and 144 during a trip operation. An impelling surface of kicker 158 is also provided on the cradle 96 for engaging a radially outwardly projecting portion or contacting surface 160 formed on the pin 106 upon the release of the cradle 96 to immediately and rapidly propel the pin 106 in a counterclockwise arc from an OPEN position to a TRIPPED position, thereby rapidly raising and separating the upper electrical contact 52 from the lower electrical contact 50.

During such a trip operation, an enlarged portion or projection 162 formed on the upper toggle links 102 is designed to contact the stop 156 with a considerable amount of force provided by the operating springs 92 through the rotating cradle 96, thereby accelerating the arcuate movements of the upper toggle links 102, the toggle spring pin 106 and the lower toggle links 104. In this manner, the speed of operation or the response time of the operating mechanism 58 is significantly increased.

The trip mechanism 82 includes the intermediate latch plate 148, a moveable or pivotable handle yoke latch 166, a torsion spring spacer pin 168, a double acting torsion spring 170 and a molded, integral or one-piece trip bar which is not shown, but rotates in response to an overcurrent induced force from the bimetallic trip mechanism or a short circuit current induced force from the electromagnetically drive armature to rotate and interact with the operating mechanism 58 to trip open the contacts 50 and 52 as will better be appreciated hereafter and is more fully described in U.S. Pat. No. 4,540,961.

In addition to the cradle latch surface 144 formed at the upper end of the elongated slot 146, the intermediate latch plate 148 includes a generally square shaped aperture 210, a trip bar latch surface 212 at the lower portion of the aperture 210, an upper inclined flat portion 214 and a pair of oppositely disposed laterally extending pivot arms 216 configured to be received within inverted keystone apertures 218 formed through the side plates 86. The configuration of the apertures 218 is designed to limit the pivotable movement of the pivot arms 216 and thus of the intermediate latch plate 148.

The handle yoke latch 166 includes an aperture 220 for receipt therethrough of one longitudinal end 222 of the pin 168. The handle yoke latch 166 is thus moveable or pivotable about the longitudinal axis of the pin 168. An opposite longitudinal end 224 of the pin 168 and the end 222 are designed to be retained in a pair of spaced apart apertures 226 formed through the side plates 86. Prior to the receipt of the end 224 in the aperture 226, the pin 168 is passed through the torsion spring 170 to mount the torsion spring 170 about an intermediately disposed raised portion 228 of the pin 168. One longitudinal end of the body of the torsion spring 170 is received against an edge 230 of a raised portion 232 of the pin 168 to retain the torsion spring 170 in a proper operating position. The torsion spring 170 includes an elongated upwardly extending spring arm 234 for biasing the flat portion 214 of the intermediate latch plate 148 for movement in a counterclockwise direction for resetting the intermediate latch plate 148 subsequently to a trip operation by the over-center toggle mechanism 80 and a downwardly extending spring arm 236 for biasing an upper portion or surface on the trip bar against rotational movement in a counterclockwise direction as is more fully described in U.S. Pat. No. 4,540,961.

The handle yoke latch 166 includes an elongated downwardly extending latch leg 240 and a bent or outwardly extending handle yoke contacting portion 242 that is physically disposed to be received in a slotted portion 244 formed in and along the length of one of a pair of downwardly depending support arms 246 of the handle yoke 88 during a reset operation. The engagement of the aforementioned downwardly depending support arm 246 by the handle yoke latch 166 prohibits the handle yoke 88 from travelling to its reset position if the contacts 72 and 306 are welded together. If the contacts 72 and 306 are not welded together, the crossbar 84 rotates to its TRIPPED position; and the handle yoke latch 166 rotates out of the path of movement of the downwardly depending support arm 246 of the handle yoke 88 and into the slotted portion 244 to enable the handle yoke 88 to travel to its reset position, passed its OPEN position. An integrally molded outwardly projecting surface 248 on the crossbar 84 is designed to engage and move the latch leg 240 of the handle yoke latch 166 out of engagement with the handle yoke 88 during the movement of the crossbar 84 from its OPEN position to its CLOSED position.

The trip bar 172 also includes a latch surface 258, shown in FIGS. 1 and 3, for engaging and latching the trip bar latch surface 212 of the intermediate latch plate 148 better shown in FIG. 2. The latch surface 258, as shown in FIG. 1, is disposed between a generally horizontally disposed surface 260 and a separate, inclined surface 262 of the trip bar 172. The latch surface 258 shown in FIG. 3 is a vertically extending surface having a length determined by the desired response characteristics of the operating mechanism 58 to an overload condition or to a short circuit or fault current condition. In the embodiment described above, an upward movement of the surface 260 of approximately one-half millimeter is sufficient to unlatch the surfaces 258 and 212. Such unlatching results in movement between the cradle 96 and the intermediate latch plate 148 along the surfaces 142 and 144, immediately unlatching the cradle 96 from the intermediate latch plate 148 and enabling the counterclockwise rotational movement of the cradle 96 and a trip operation of the circuit breaker 30. During a reset operation, the spring arm 236 of the torsion spring 170 engages a surface on the trip bar 237 causing the surface 237 to rotate counterclockwise to enable the latch surface 258 of the trip bar 172 to engage and relatch with the latch surface 212 of the intermediate latch plate 148 to reset the intermediate latch plate 148, the trip bar 172 and the circuit breaker 30. The length of the curved surface 157 of the cradle 96 should be sufficient to retain contact between the upper portion 214 of the intermediate latch plate 148 and the cradle 96 to prevent resetting of the intermediate latch plate 148 and the trip bar 172 until the latch surface 142 of the cradle 96 is positioned below the latch surface 144 of the intermediate latch plate 148. Preferably, each of the three poles or phases of the circuit breaker 30 is provided with a bimetallic, an armature and a magnet for displacing the associated leg 194 of the trip bar 172 as a result of the occurrence of an overload condition or of a short circuit or fault current condition in any one of the phases to which the circuit breaker 30 is connected.

In addition to the integral projecting surface 248, the crossbar 84 includes three enlarged sections 270, separated by round bearing surfaces 272. A pair of peripherally disposed, outwardly projecting locators 274 are provided to retain the crossbar 84 in proper position within the base 36. The base 36 includes mating bearing surfaces complimentarily shaped to the bearing surfaces 272 for receiving the crossbar 84 for rotational movement in the base 34. The locators 274 are received within arcuate recesses or grooves in the base. Each enlarged section 270 further includes a pair of spaced apart apertures 280 for receiving the toggle contact pin 110. The pin 110 may be retained within the apertures 280 by any suitable means, for example, by an interference fit therebetween.

Each enlarged section 270 also includes a window pocket or fully enclosed opening 282 formed therein for receipt of one longitudinal end or base portion 284 of the upper electrical contact 52. The opening 282 also permits the receipt and retention of a contact arm compression spring 286 and an associated, formed, spring follower 288. The compression spring 286 is retained in proper position within the enlarged section 270 by being disposed about an integrally formed, upwardly projecting boss 290.

The spring follower 288 is configured to be disposed between the compression spring 286 and the base portion 284 of the upper electrical contact 52 to transfer the compressive force from the spring 286 to the base portion 284, thereby ensuring that the upper electrical contact 52 and the crossbar 84 move in unison. The spring follower 288 includes a pair of spaced apart generally J-shaped grooves 292 formed therein for receipt of a pair of complimentary shaped, elongated ridges or shoulder portions 294 to properly locate and retain the spring follower 288 in the enlarged section 270. A first generally planar portion 296 is located at one end of the spring follower 288; and a second planar portion 298 is located at the other longitudinal end of the spring follower 288 and is spaced from the portion 296 by a generally flat incline portion 300.

The shape of the spring follower 288 enables it to engage the base portion 284 of the upper electrical contact 52 with sufficient spring force to ensure that the upper electrical contact 52 allows the movement of the crossbar 84 in response to operator movements of the handle 42 or the operation of the operating mechanism 58 during a normal trip operation. However, upon the occurrence of a high level short circuit or fault current condition, the upper electrical contact 52 can rotate about the pin 110 by deflecting the spring follower 288 downwardly, enabling the electrical contacts 50 and 52 to rapidly separate and move to their BLOWN-OPEN positions without waiting for the operating mechanism 58 to sequence. This independent movement of the upper electrical contact 52 under a high fault condition is possible in any pole or phase of the circuit breaker 30.

In addition to the apertures 100, 218 and 226, the side plates 86 include apertures 310 for the receipt and retention of the opposite ends of the stop pin 90. In addition, bearing or pivot surfaces 312 are formed along the upper portion of the side plates 86 for engagement with a pair of bearing surfaces or round tabs 314 formed at the lower most extremities of the downwardly depending support arms 246 of the handle yoke 88. The handle yoke 88 is thus controllably pivotal about the bearing surfaces 314 and 312. The side plates 86 also include bearing surfaces 316 for contacting the upper portions of the bearing surfaces 272 of the crossbar 84 and for retaining the crossbar 84 securely in position within the base 34. The side plates 86 include generally C-shaped bearing surfaces 317 configured to engage a pair of round bearing surfaces disposed between support sections of the trip bar 172 for retaining the trip bar 172 in engagement with a plurality of retaining surfaces integrally formed as part of the molded base 34. Each of the side plates 86 includes a pair of downwardly depending support arms 322 that terminate in elongated, downwardly projecting stakes or tabs 324 for securely retaining the side plates 86 in the circuit breaker 30. Associated with the tabs 324 are apertured metal plates 326 that are configured to be received in recesses in the base 34. In assembling the supports plates 86 in the circuit breaker 30, the tabs 324 are passed through apertures formed through the base 34 and, after passing through the apertured metal plates 326, are positioned in the recesses in the base 34. The tabs 324 may then be mechanically deformed for example by pining, to lock the tabs 324 in engagement with the apertured metal plates 326, thereby securely retaining the side plates 86 in engagement with the base 34. A pair of formed electrically insulating barriers are used to electrically insulate conductive compartments and surfaces in one pole or phase of the circuit breaker 30 from the conductive compartments or surfaces in an adjacent pole or phase of circuit breaker 30.

Thus, the general operation of the operating mechanism 58 in response to overcurrent or short circuit conditions can be appreciated. A more detailed understanding of the operation of the breaker can be obtained from U.S. Pat. No. 4,540,961. The foregoing description, however, provides a sufficient teaching of the operating mechanism 58 to appreciate the improvement provided by this invention described hereafter.

Figure 4:
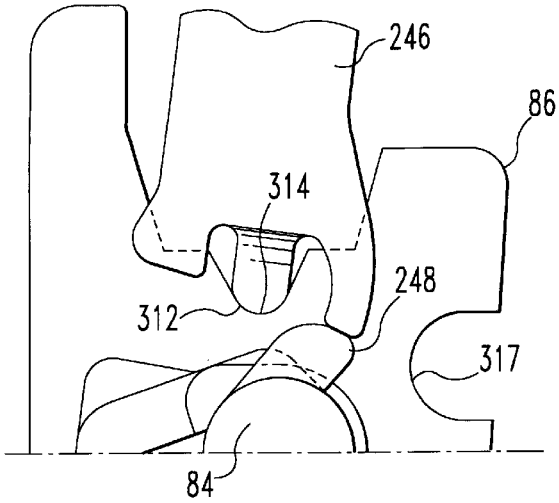
FIG. 4 PRIOR ART
FIG. 4 is a side schematic, plan view of the side plate, handle and crossbar assembly of the prior art device illustrated in FIG. 2.
Figure 5:
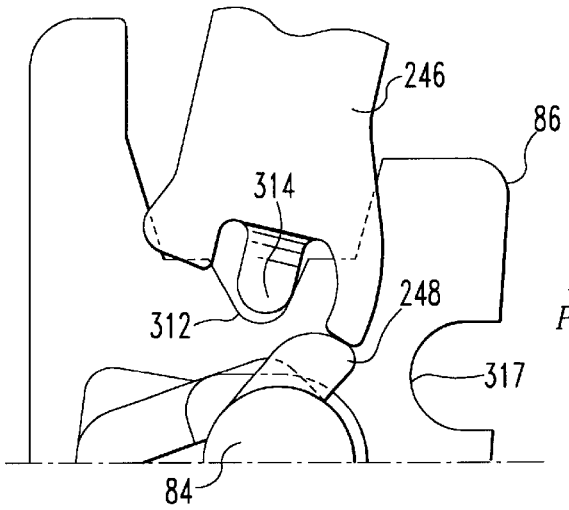
FIG. 5 PRIOR ART
FIG. 5 is the plan view of FIG. 4 with the handle activated under a condition where the contacts are welded, illustrating a problem encountered with the prior art design.

The existing generally V-shaped groove which forms the bearing's surface 312 shown in FIGS. 2, 4 and 5 has created some operating difficulties under certain fault conditions where the contacts 306 and 72 become welded. Under most operating conditions the structure previously described works well. However, when the contacts 72 and 306 are welded the handle arm 246 rotation is stopped by hitting the bump 248 on the crossbar 84. This causes the handle arm 246 to lift up off the bearing surface 312 allowing the handle arm 246 to move further toward the off position as shown in FIG. 5 giving the false impression that the contacts are being opened.

Figure 6:
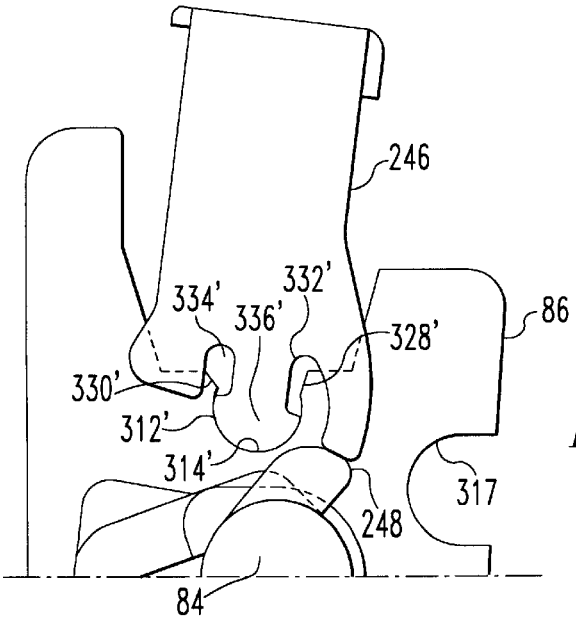
FIG. 6 illustrates a modification to the design shown in the plan view of FIGS. 4 and 5, illustrating the contribution of this invention.

The invention overcomes this difficulty by capturing a bearing surface within a groove as shown in FIG. 6. This is accomplished by providing a curved bearing surface 312' having a constant radius preferably extending more than 180° providing a lip 328' and 330' on either side of the bearing surface 312'. The mating bearing surface 314' on the handle arm 246 has a matching curvature to that of the bearing surface 312' but extends over a smaller arc and is retained within the opening defined by the bearing surface 312' by the extensions of the arc 312' that form the lips 328' and 330'. The arc of the bearing surface 312' leaves an opening 334' which is smaller than the width of the tab 336' which carries the bearing surface 314'. Therefore, the tab 336' is captured within the groove defined by the bearing surface 312' and cannot lift out of that socket when the handle arm 246 rides over the crossbar bump 248. The necked down portioned 332' that attaches the tab 336' to the body of the handle arm 246 has a smaller width than the tab 336' which enables the handle to rotate within the socket defined by the bearing surface 312'. It should be appreciated that the tab portion 336' can be inserted into the groove defined by the bearing surface 312' by either snapping the tab 336' in from the opening 334' or by sliding it in from the side during manufacture. Thus, this invention prevents movement of the handle without corresponding movement of the moveable contact 52.

While specific embodiments of the invention have been described in detail, it will be appreciated by those skilled in the art that various modifications and alternatives to those details could be developed in light of the overall teachings of the disclosure. Accordingly, the particular arrangement disclosed are meant to be illustrative only and not limiting as to the scope of invention which is to be given the full breath of the claims appended and any and all equivalents thereof.

What is claimed is:

1. A circuit interrupter having an operating mechanism including an over-center toggle mechanism, comprising:

a pair of spaced apart, juxtaposed side plates, with at least one of the side plates having a curved concave groove In an end portion of the plate, which is substantially circular with an arc that extends X degrees, the radial surface of said groove forming a first bearing surface; and a moveable member having an extended portion with a curved end that matches the curvature of the groove with the radial surface of the curved end forming a second bearing surface that rides on said first bearing surface, wherein the curved end portion of the moveable member has an arc that extends less than x degrees, where X is less than 360° but greater than 180° and captures the curved end within the groove while pressure is placed on the moveable member to move the member from one position to another.

2. A circuit interrupter having an operating mechanism including an over-center toggle mechanism, comprising:

a pair of spaced apart, juxtaposed side plates, with at least one of the side plates having a curved concave groove in an end portion of the plate, which is substantially circular with an arc that extends X degrees, the radial surface of said groove forming a first bearing surface;

a moveable member having an extended portion with a curved end that matches the curvature of the groove with the radial surface of the curved end forming a second bearing surface that rides on said first bearing surface where X is less than 360° but large enough to capture the curved end within the groove while pressure is placed on the moveable member to move the member from one position to another;

wherein the end portion of the plate adjacent the groove has a lip that extends over the groove; and wherein the wall of the groove are resilient and the second bearing surface snaps into the groove.

* * * * *